US009121650B2

(12) United States Patent
Iannello et al.

(10) Patent No.: US 9,121,650 B2
(45) Date of Patent: Sep. 1, 2015

(54) AMMUNITION FEED GUIDE ASSEMBLY

(71) Applicant: ILLINOIS TOOL WORKS INC., Glenview, IL (US)

(72) Inventors: Christopher A. J. Iannello, Rolling Meadows, IL (US); Craig E. Ernst, Jr., Marlboro, NY (US); Martin J. Nilsen, Hampshire, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 14/351,146

(22) PCT Filed: Oct. 12, 2012

(86) PCT No.: PCT/US2012/059850

§ 371 (c)(1),
(2) Date: Apr. 11, 2014

(87) PCT Pub. No.: WO2013/106110

PCT Pub. Date: Jul. 18, 2013

(65) Prior Publication Data

US 2014/0260931 A1 Sep. 18, 2014

Related U.S. Application Data

(60) Provisional application No. 61/546,852, filed on Oct. 13, 2011.

(51) Int. Cl.

| | |
|---|---|
| ***F41A 9/34*** | (2006.01) |
| ***F41A 9/79*** | (2006.01) |
| ***F41A 9/57*** | (2006.01) |

(52) U.S. Cl.
CPC ... *F41A 9/34* (2013.01); *F41A 9/57* (2013.01); *F41A 9/79* (2013.01)

(58) Field of Classification Search
CPC ..... F41A 9/00; F41A 9/04; F41A 9/05; F41A 9/34; F41A 9/79
USPC ..... 89/33.2
See application file for complete search history.

(56) References Cited

U.S. PATENT DOCUMENTS

| | | | | |
|---|---|---|---|---|
| 2,477,264 A * | 7/1949 | Pearson et al. | ..... | 193/25 AC |
| 2,740,180 A | 4/1956 | Nobles | | |
| 3,788,189 A * | 1/1974 | Sachleben et al. | ..... | 89/34 |

FOREIGN PATENT DOCUMENTS

| | | | |
|---|---|---|---|
| DE | 644053 C | | 4/1937 |
| GB | 604291 A | | 7/1948 |
| WO | WO 2009/030385 | * | 3/2009 |

OTHER PUBLICATIONS

ISR for PCT/US2012/059850 mailed Jul. 16, 2013.

*Primary Examiner* — Stephen M Johnson

(57) ABSTRACT

An ammunition feed guide assembly for a connected band of ammunition cartridges includes a bracket with upstanding side plates each defining an ammunition discharge channel. The channel has a bottom wall, a pair of side walls spaced apart a distance greater than the length of a cartridge and may include at least one tension tab to resist movement of the ammunition band. An ammunition chute is connected to a discharge chute and comprises a plurality of hollow feed links connected for limited pivotal movement to guide the band of ammunition cartridges to the feed mechanism of an associated weapon. In one form, the chute includes a link at its free end to connect to a discharge chute of another feed guide assembly.

15 Claims, 9 Drawing Sheets

AMMUNITION FEED GUIDE ASSEMBLY

CROSS-REFERENCE TO RELATED APPLICATION

The present application is a National Phase of International Application Number PCT/US2012/059850 filed Oct. 12, 2012 and claims priority pursuant to Title 35 USC §119(e) to U.S. Provisional Application Ser. No. 61/546,852 entitled "Ammunition Feed Guide Assembly" filed Oct. 13, 2011, the entire specification and drawings of which are hereby incorporated by reference herein as if fully set forth.

BACKGROUND OF THE INVENTION

This disclosure relates to a mechanism to guide delivery of linked ammunition. More particularly, it relates to a versatile guide delivery mechanism for use with existing ammunition containers to define a variable length, flexible delivery path between storage containers and between a storage container and the weapon.

Ammunition for automatic and semi-automatic weapons includes individual cartridges linked by a web or a series of formed clips to form a chain or band. The weaponry is configured to receive the forward most cartridge and, through an appropriate feed mechanism associated with, or internal to the weapon, advance the cartridges or rounds into the firing chamber. Such linked ammunition is often carried in an ammunition box or bag that contains an elongate band of several hundred rounds. The band is folded upon itself in serpentine fashion to provide smooth exit from the container.

In some instances it has been found that smooth flow of ammunition is impeded by undesirable interactions with the container. This condition has been experienced in connection with ammunition bands carried in cloth bags.

SUMMARY OF DISCLOSURE

The present disclosure is directed to a guide mechanism insertable into an ammunition box or bag that provides a guide path for delivery of the cartridge band to the weapon. It is also suitable for transfer of banded cartridges from one source into another ammunition container.

An ammunition feed guide assembly for a connected band of ammunition cartridges of this disclosure comprises a bracket including at least one upstanding side plate defining an ammunition discharge channel having a bottom wall and a pair of side walls spaced apart a distance greater than the length of a cartridge. An ammunition chute is connected to the discharge channel. It comprises a plurality of hollow feed links connected for limited pivotal movement to guide the band of ammunition cartridges to the feed mechanism of an associated weapon. In one form, the chute includes a link at its free end to connect to a discharge chute of another feed guide assembly.

DETAILED DESCRIPTION OF ILLUSTRATED EMBODIMENTS

Figure 1:
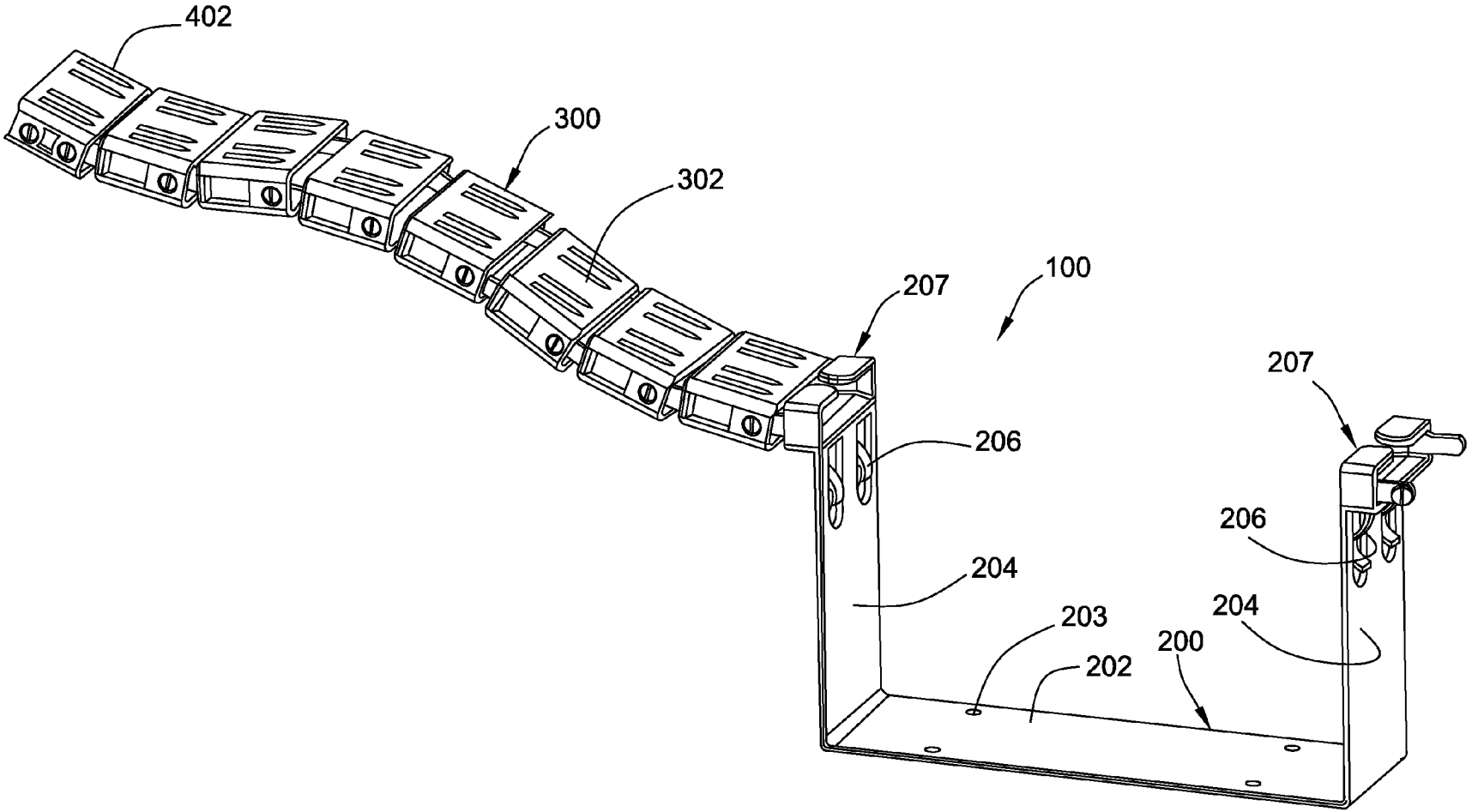
FIG. 1 is a perspective view of an ammunition feed guide assembly in accordance with the present disclosure.

FIG. 1 illustrates an embodiment of the ammunition feed guide assembly, generally designated 100. It is sized to be positioned within a typical ammunition bag or can which defines a rectangular chamber having a lateral width slightly larger than the length of the ammunition cartridges.

Figure 2:
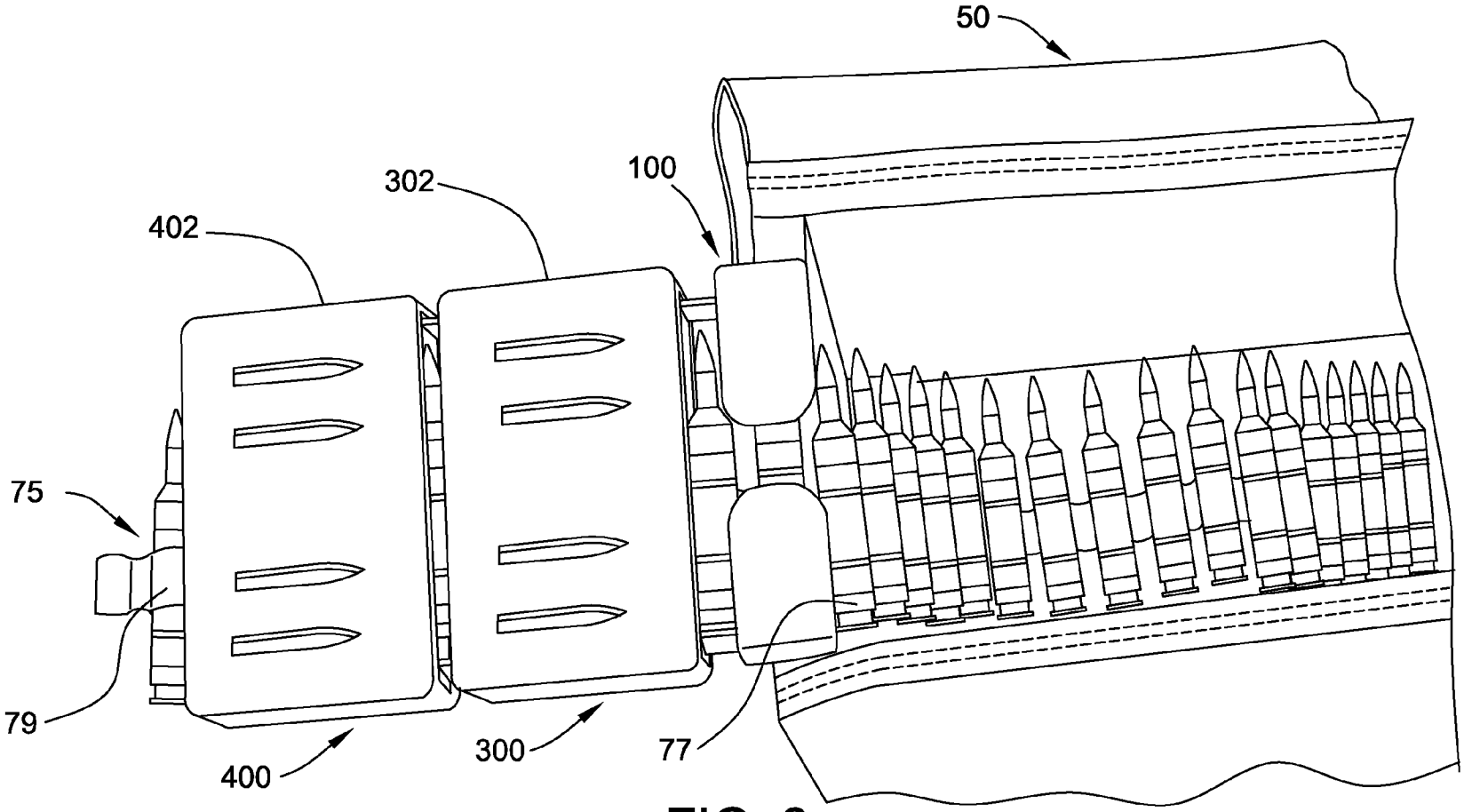
FIG. 2 is a perspective view of the ammunition feed guide of FIG. 2 installed into a typical cloth ammunition carrier bag or container.

The assembly 100, containing an ammunition or cartridge band 75 of parallel aligned individual cartridges 77 held together by disposable webs 79, is shown in FIG. 2 disposed within an ammunition bag 50. Details of the separate components of the assembly 100 are shown in FIGS. 1 and 3 to 5.

Referring to FIG. 1, the ammunition feed guide assembly 100 includes an attachment bracket 200 sized to be positioned within an ammunition bag prior to insertion of the ammunition band 75. It includes a flexible ammunition chute, generally 300, defined by a plurality of joined guide feed links 302. An end link 402 defines a free end of the chute for association with a weapon or another ammunition container.

Figure 3:
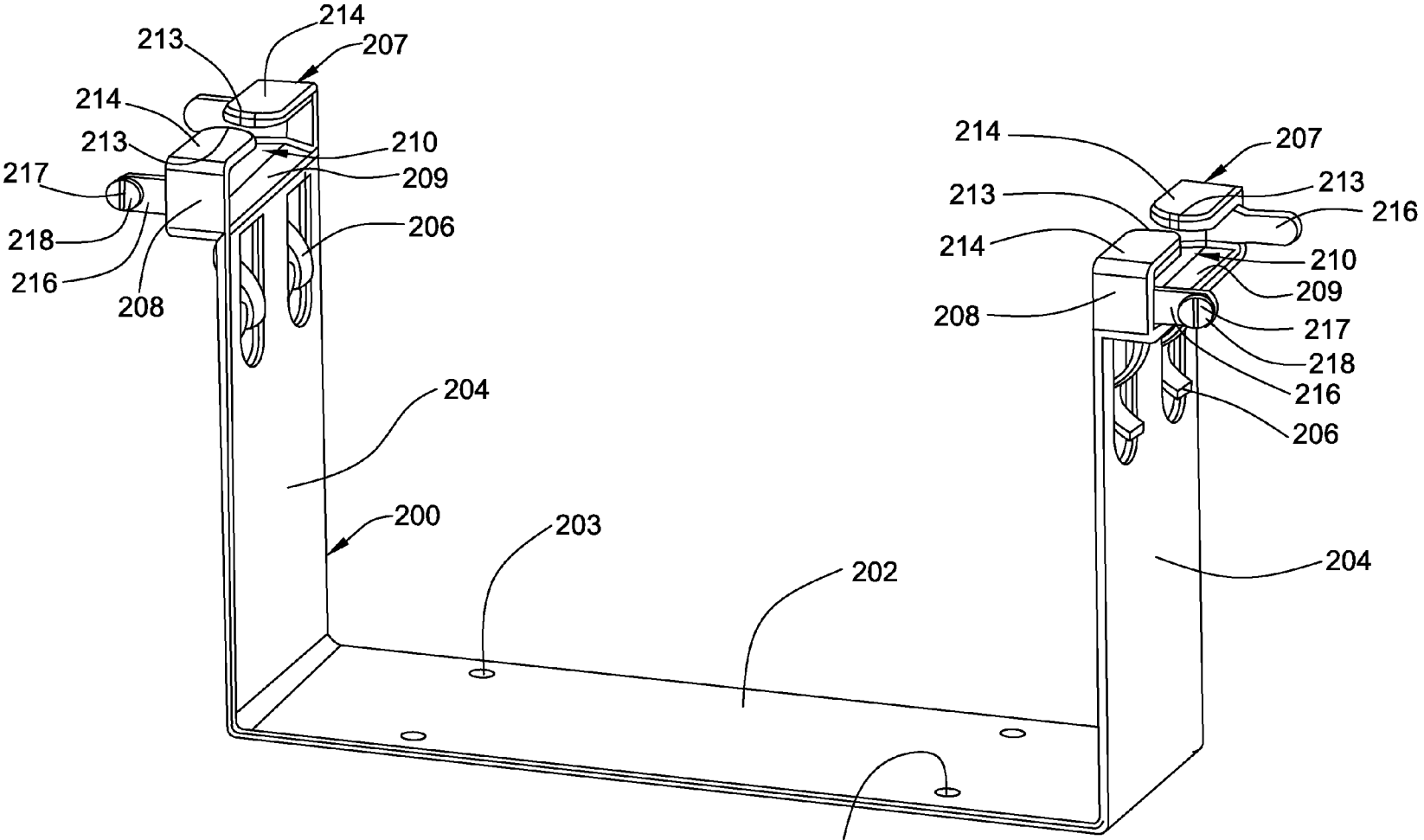
FIG. 3 is a perspective view of the bracket of the ammunition feed guide assembly of FIG. 1.

Referring to FIG. 3, attachment bracket 200 is molded plastic and includes a base plate 202 and two upstanding side plates 204. The width of these components is slightly larger than the length of the ammunition cartridges in the band 75, which is typically comprised of 5.56 mm or 7.62 mm cartridges. The base plate 202 is of a length to fit along the bottom of an ammunition bag such as bag 50 with each side plate 204 rising adjacent the lateral side walls of the bag. The base plate 202 may include holes 203 for drainage or escape of debris. The side plates 204 may include molded clips 206 to attach the assembly 100 to the bag 50. It should be noted that the assembly 100 is also suitable for use with a typical rigid ammunition carrier container made of metal or plastic.

The free end of each upstanding side plate 204 defines a cartridge discharge channel 207 that extends outward from each lateral edge of the container opening. Because there are two discharge channels 207, ammunition may be discharged from either lateral edge of container 50. In this description, inward means toward the interior of the ammunition container. Outward means in the ammunition discharge direction along the ammunition flow path. Lateral means perpendicular to the ammunition flow path.

As best seen in FIG. 3, each discharge channel 207 includes a bottom wall 210, two side walls 208 spaced apart a distance slightly greater than the length of an individual cartridge, and two flat tension tabs 214 extending from side walls 208 with free ends 213 disposed in laterally inward facing relation. The free ends 213 of tabs 214 are spaced from the bottom wall 210 a distance such that with the ammunition band 75 extending through the channel 207, the tabs apply a restraining force upon the cartridge band 75 to resist movement of the band 75 inward into the container 50.

The bottom wall 210 of discharge channel 207 is provided with a ramp 209 at its inward and outward ends to assure smooth flow of the cartridge band 75 through the channel 207.

A pair of cantilevered flex arms 216 extend from side walls 208 of each discharge channel 207 in the direction of ammunition discharge. Each arm 216 is integrally molded, and cantilevered from a side wall 208. Each flex arm 216 includes a free end having a latching button 217 on its laterally outer surface for connection to a further component of the assembly.

The latching buttons 217 are cylindrical and of decreasing thickness toward the free ends of flex arms 216 in the outward or ammunition discharge direction. These buttons form an arcuate retention edge 218 for releasable connection with coacting latching apertures as will be explained.

Figure 4:
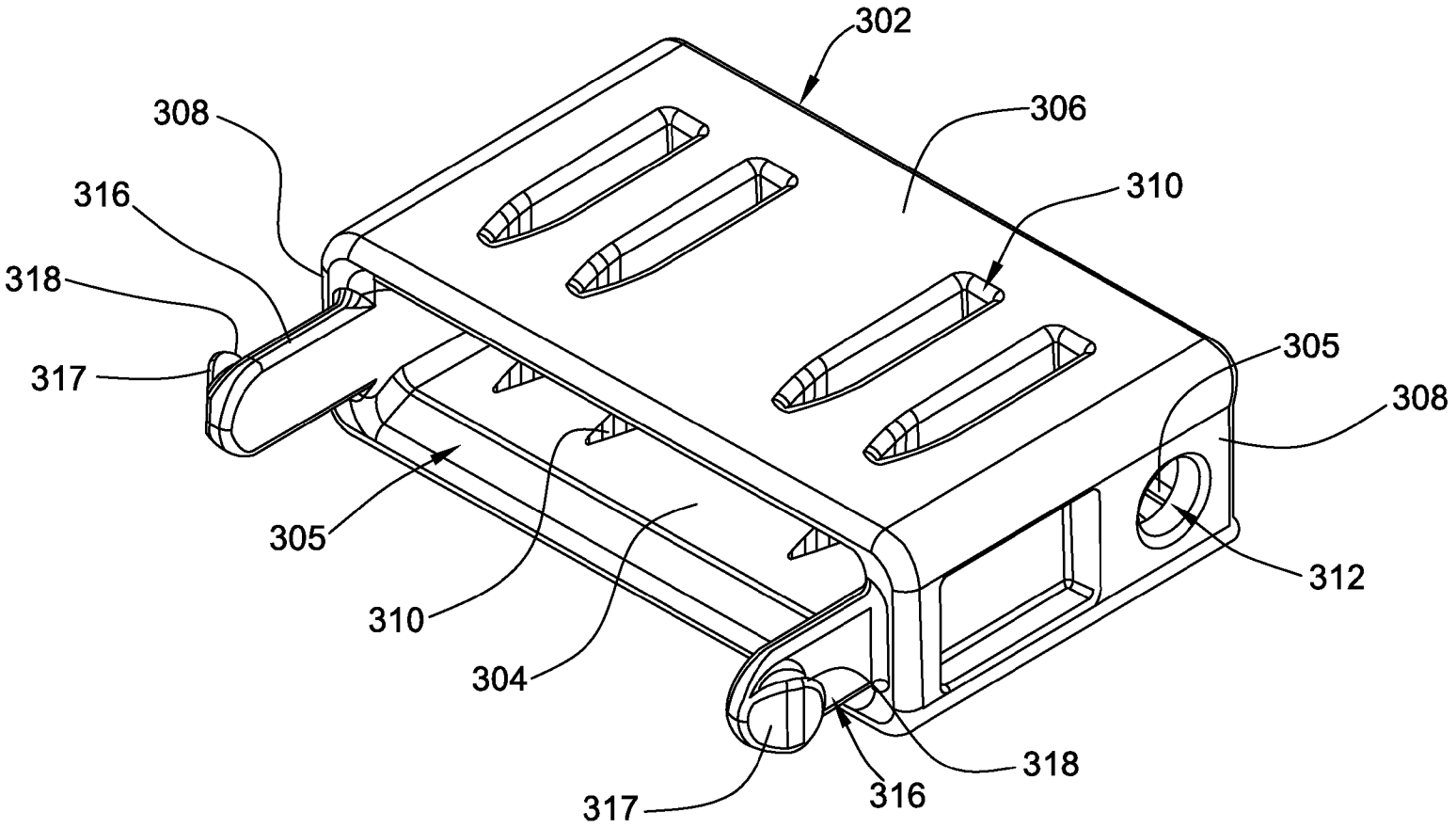
FIG. 4 is a perspective view of a feed link of the ammunition feed guide assembly of FIG. 1.

Chute 300 seen in FIG. 1, is made up of multiple, channel shaped, hollow feed links 302 having a bottom wall 304, a top wall 306 and side walls 308 (See FIG. 4). The links are also made of molded plastic and are releasably joined together to form a chute of any desired length. The ammunition band 75 passes through the interior of the links surrounded by the walls 304, 306 and 308.

Each top wall 306 and bottom wall 304 includes one or more slots 310. Slots 310 provide for visual inspection of the contained ammunition band 75 and permit any liquid or debris to exit the chute. The bottom wall 304 includes a ramp 305 at its inward and outward ends to facilitate cartridge advancement.

A pair of parallel cantilevered flex arms 316 extend outward from side walls 308 in the direction of cartridge band travel. Each includes a latching button 317 on its laterally outer surface, shaped similarly to latching button 217 of a discharge channel 207. The buttons 317 are cylindrical and of decreasing thickness toward the free ends of flex arms 316, in the outward or ammunition discharge direction. These buttons form an arcuate retention edge 318 for releasable connection with coacting latching apertures as will be discussed below.

Each side wall 308 includes a cylindrical latching aperture 312 near its inward end aligned with the latching aperture in the opposite side wall. The apertures 312 are sized to pivotally receive a latching button 217 of a discharge channel 207 or a latching button 317 of another discharge chute feed link 302. The centers of the aligned sets of latching apertures 312 are spaced outward from the inward edge of the side wall 308 a distance somewhat shorter than the length of flex arms 216 from side walls 208 or flex arms 316 from side walls 308 to the center of latching buttons 217 or 317.

A chute 300 of any desired length is created by connecting a selected number of feed links 302 together by securing latching buttons 317 of one link within the latching apertures 312 of an adjacent link. The flex arms 316 are depressed and deformed toward each other to accomplish this connection. Once released, the flex arms 316 return to their parallel relationship and maintain the latching buttons 317 within the apertures 312 of the adjacent feed link 302.

The chute 300, created by the feed links 302, is connected to one of the discharge channels 207 of the attachment bracket 200 by placement of the latching buttons 217 of the discharge channel 207 into the latching apertures 312 of the first link 302 of the chute. The flex arms 216 are deformed toward each other to accomplish this connection. Once released the flex arms 216 return to their parallel relationship. Notably, the outward tapered shape of latching button 217 of flex arms 216 and latching buttons 317 of flex arms 316 facilitate deformation of arms 216 and 316 during the connection process.

Figure 5:
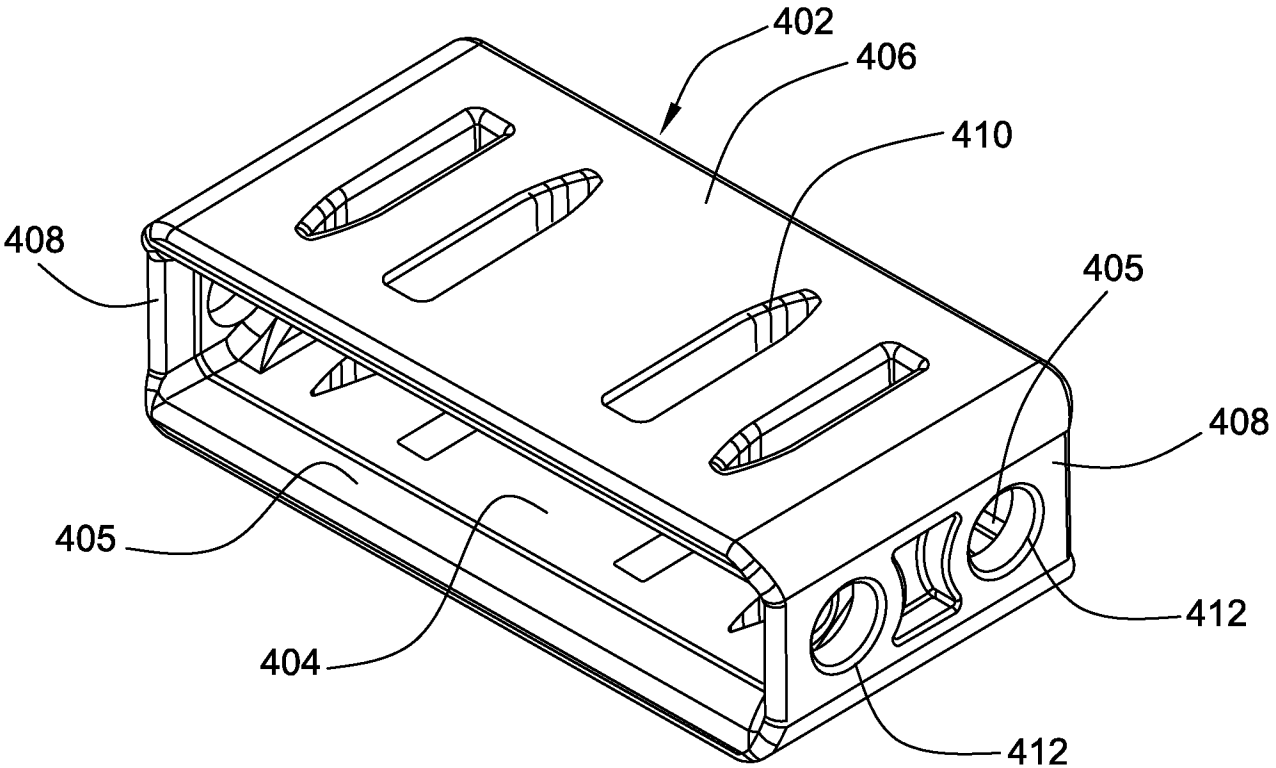
FIG. 5 is a perspective view of an end link of the ammunition feed guide assembly of FIG. 1.

The chute 300 can be terminated at its free end in the direction of ammunition discharge, by end link 402 shown in FIG. 5. Each link 402 is a hollow molded plastic component having a bottom wall 404, a top wall 406 and side walls 408. The walls are spaced similarly to the walls 304, 306 and 308 of feed links 302, that is, to closely surround, but permit free passage of the ammunition band 75.

Top wall 406 and bottom wall 404 include slots 410 for visual inspection purposes, and to assure against collection of debris within the internal channel defined by the walls 404, 406 and 408. Bottom wall 404 includes ramps 405 at its inward and outward ends to assure smooth flow of the cartridge band.

The end links 402 differ from feed links 302 in that they do not include cantilever arms extending in the direction of ammunition travel. Rather, each side wall 408 includes two spaced latching apertures 412 aligned with a similar aperture 412 in the opposite side wall 408. The latching apertures are sized to pivotally receive a latching button 317 of an adjacent feed link 302 or a latching button 217 of a discharge channel 207 of attachment bracket 200.

The centers of the aligned sets of latching apertures 412 are spaced respectively from the inward and outward edges of side walls 408 in the same relationship as the spacing of the centers of latching apertures 312 relative to the inward edge of side walls 308. That is, they are somewhat closer to the inward and outward edges of side walls 408 than the length of flex arms 216 or 316 from side walls 208 or 308 to the center of latching buttons 217 and 317.

End link 402 may be used to terminate a chute 300 formed of a plurality of feed links 302 adjacent the feed mechanism of an associated weapon, or it may be employed to connect a chute 300 of another source such as an adjacent ammunition container to the cartridge channel 207 at the opposite end of the attachment bracket 200 from where the bracket 200 includes a discharge chute 300. In this later configuration, an ammunition band such as band 75 may be fed into a container from an adjacent source.

The previously described spacing of latching apertures 312 and 412 and latching buttons 216 and 316 relative to the edges of side walls 208, 308 or 408 permits limited pivotal movement of the feed links 302 or end link 402 relative to each other and to discharge channel 207. Thus when connected, a degree of flexibility exists between adjacent components.

It is contemplated that the feed guide assembly 100 will be advantageously employed with attachment bracket 200 disposed within an ammunition carrier such as bag 50 with a discharge channel 207 extending outward at each lateral edge of the bag opening. The bag will contain an ammunition band 75 of connected aligned cartridges 77 in serpentine layers.

A discharge chute 300 of predetermined length formed of pivotally connected feed links 302 with an end link 402 at one end is connected to a discharge channel 207. That is, the latching buttons 317 of each feed link 302 are disposed in the latching apertures 312 of an adjacent feed link. The latching buttons 317 of the feed link 302 adjacent end link 402 are disposed in the inward latching apertures 412 of the end link 402. The connected links 302 and link 402 create a chute 300 sufficiently flexible to accommodate placement of the ammunition band through the hollow interior of the links and into operative association with a weapon by virtue of the pivotal relationship between the latching buttons 317 and the latching apertures 312 and 412.

The chute 300 is connected to attachment bracket 200. That is, the latching buttons 217 on the flex arms 216 of a discharge channel 207 of bracket 200 are disposed within the latching apertures 312 of the feed link 302 at inward end of chute 300. A free end of ammunition band 75 is passed through discharge channel 207 and through chute 300. The band 75 may be operatively associated with a weapon, or it may be connected to a discharge channel 207 of another ammunition container for delivery of the ammunition band to that container. In this latter arrangement, the latching buttons 217 of flex arms 216 of the discharge channel 207 are disposed in the outward set of latching apertures 412 in side walls 408 of end link 402.

Notably, the lateral spacing between flex arms 216 of the cartridge discharge channels 207 and the flex arms 316 of feed links 302 is such that, with the ammunition band in place, the arms cannot be deformed toward each other sufficiently to disconnect the latching buttons 217 or 317 from latching apertures 312 or 412.

Figure 6:
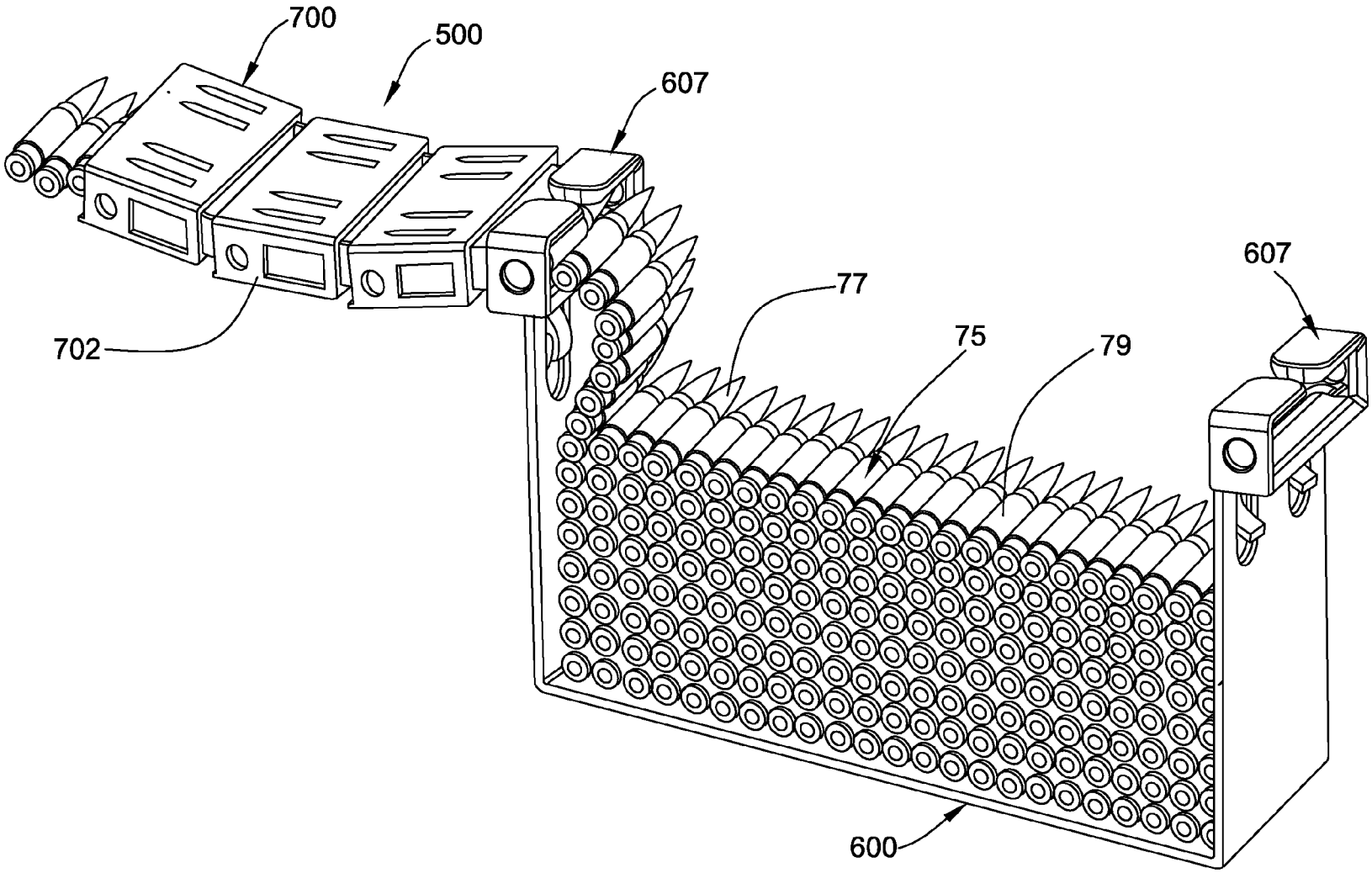
FIG. 6 is a perspective view of an alternative form of ammunition feed guide assembly of the present disclosure.

FIGS. 6 to 9 illustrate an alternative arrangement for an ammunition feed guide assembly. FIG. 6 illustrates an embodiment of the ammunition feed guide assembly, generally designated 500. It is sized to be positioned within a typical ammunition bag or can such as bag 50 shown in FIG. 2 which typically defines a rectangular chamber having a lateral width slightly larger than the length of the ammunition cartridges.

Figure 8:
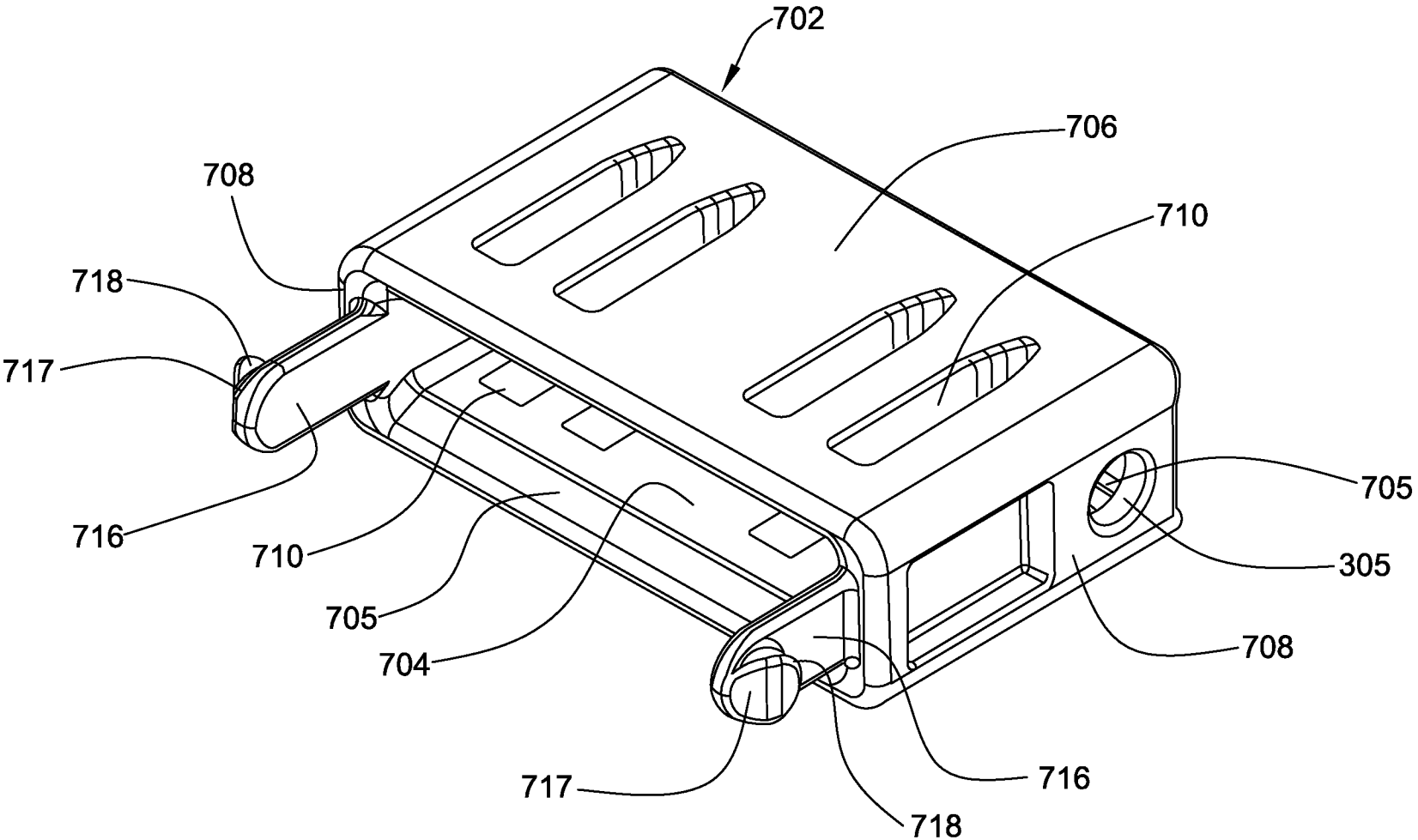
FIG. 8 is a perspective view of a feed link of the ammunition feed guide assembly of FIG. 6.
Figure 9:
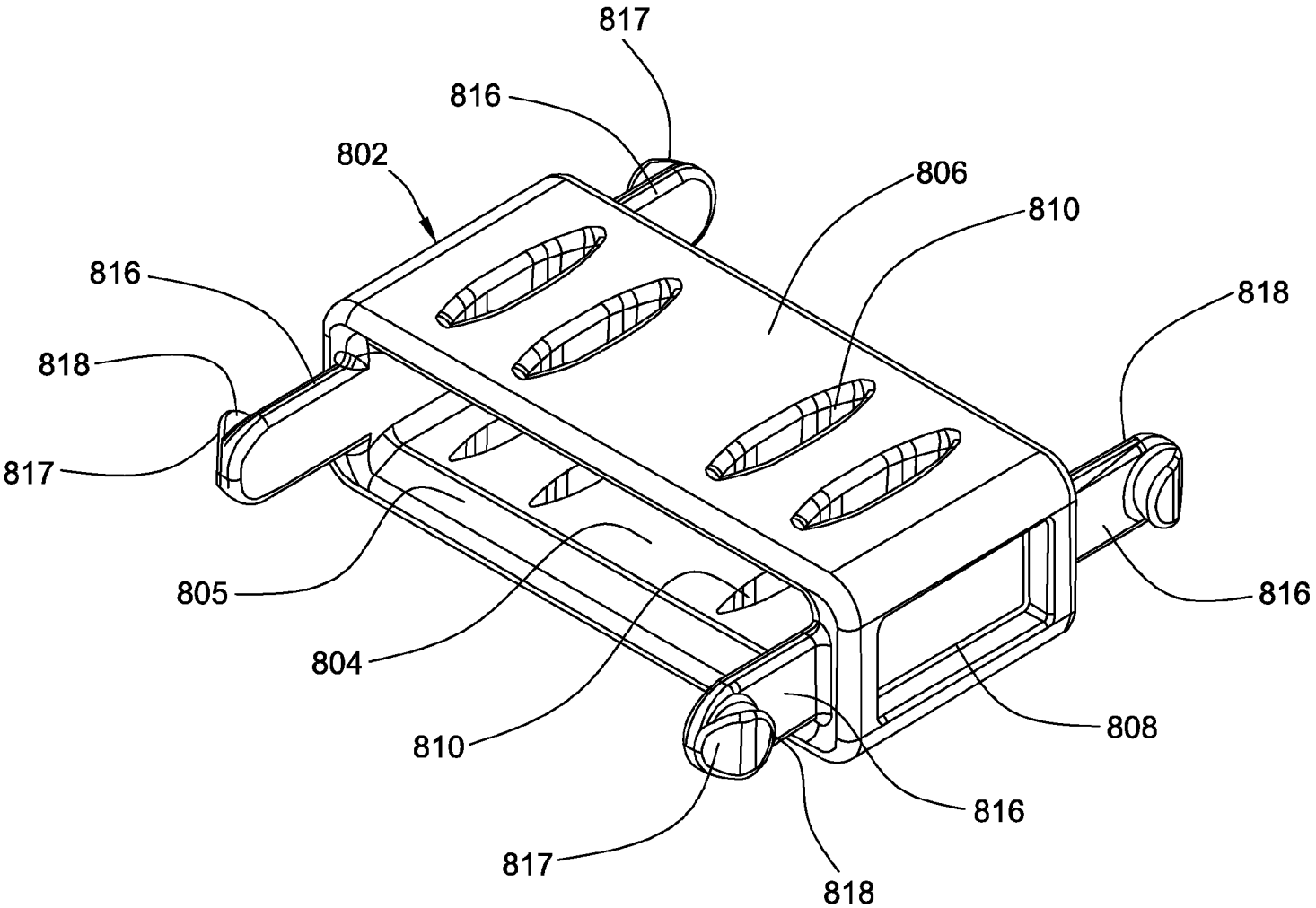
FIG. 9 is a perspective view of a connecting link for the ammunition feed guide assembly of FIG. 6.

The assembly 500, containing an ammunition or cartridge band 75 of parallel aligned individual cartridges 77 held together by disposable webs 79, is shown in FIG. 6. Details of the separate components of the assembly 500 are shown in FIGS. 7 to 9.

Referring to FIG. 6, the ammunition feed guide assembly 500 includes an attachment bracket 600 sized to be positioned within an ammunition bag prior to insertion of the ammunition band 75. It includes a flexible ammunition chute, generally 700, defined by a plurality of joined guide feed links 702.

Figure 7:
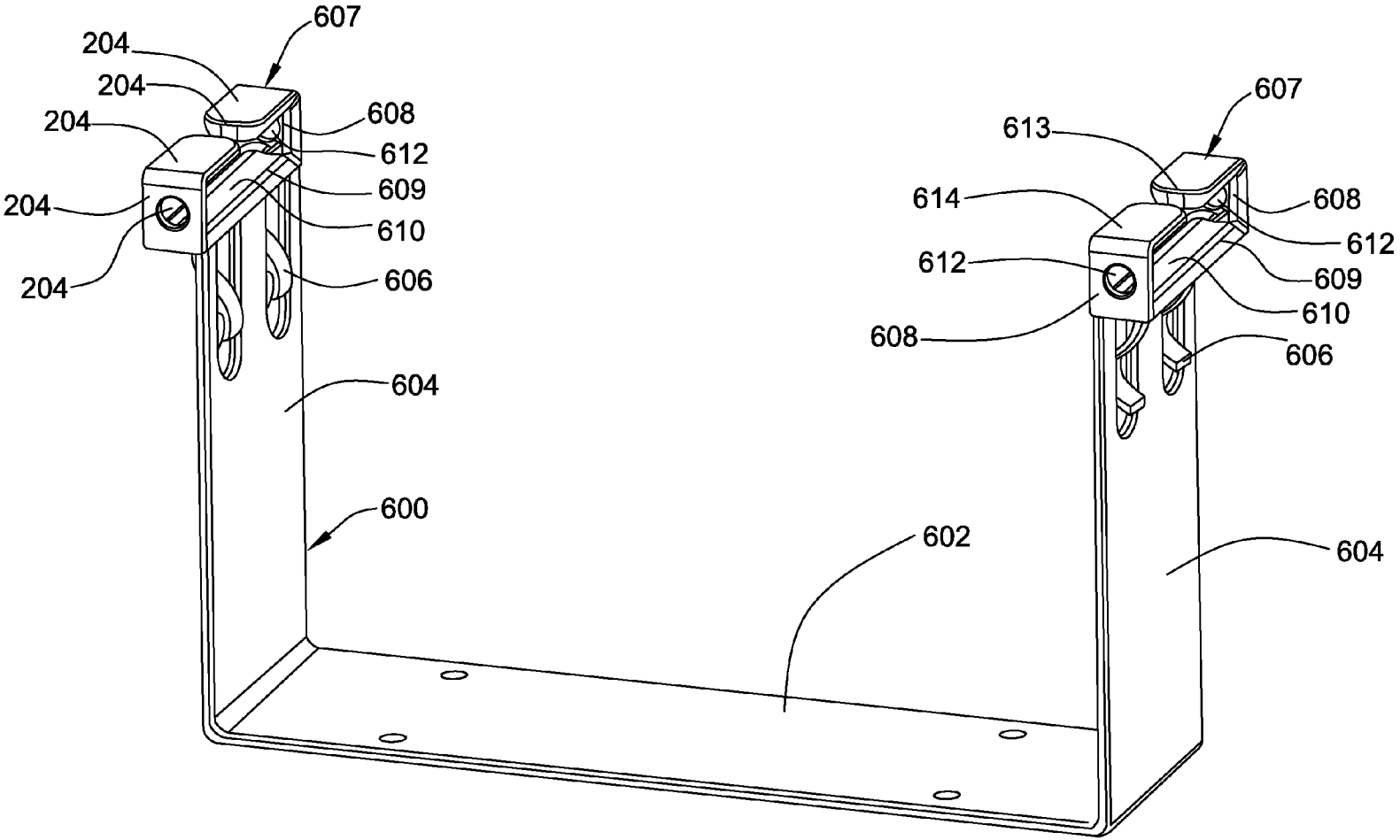
FIG. 7 is a perspective view of the bracket of the feed guide assembly of FIG. 6.

Referring to FIG. 7, attachment bracket 600 is molded plastic and includes a base plate 602 and two upstanding side plates 604. The width of these components is slightly larger than the length of the ammunition cartridges in the band 75, which is typically comprised of 5.56 mm or 7.62 mm cartridges. The base plate 602 is of a length to fit along the bottom of an ammunition bag such as bag 50 of FIG. 2 with each side plate 604 rising adjacent the lateral side walls of the bag. The side plates 604 may include molded clips 606 to attach the assembly 500 to a bag 50. It should be noted that the assembly 500 is also suitable for use with a typical rigid ammunition carrier container made of metal or plastic.

The free end of each upstanding side plate 604 defines a cartridge discharge channel 607 that extends outward from each lateral edge of the container opening. Because there are two discharge channels 607, ammunition may be discharged from either lateral edge of container 50 as seen in the previous embodiment.

As best seen in FIG. 7, each discharge channel 607 includes a bottom wall 610, two side walls 608 spaced apart a distance slightly greater than the length of an individual cartridge, and two flat tension tabs 614 extending from side walls 608 with free ends 613 disposed in laterally inward facing relation. The free ends 613 of tabs 614 are spaced from the bottom wall 610 a distance such that with the ammunition band 75 extending through the channel 607, the tabs apply a restraining force upon the cartridge band 75 to resist movement of the band 75 inward into the container 50.

Each side wall 608 includes a cylindrical latching aperture 612 aligned with the latching aperture 612 in the opposite wall. The apertures 612 are about mid-way between the inward and outward edges of each side wall 608. The bottom wall 610 of discharge channel 607 is provided with a ramp 609 at its inward and outward ends to assure smooth flow of the cartridge band 75 through the channel 607.

Chute 700 seen in FIG. 6, is made up of multiple, channel shaped, hollow feed links 702 having a bottom wall 704, a top wall 706 and side walls 708 (See FIG. 8). The links are also made of molded plastic and are releasably joined together to form a chute of any desired length. The ammunition band 75 passes through the interior of the links surrounded by the walls 704, 706 and 708.

Each top wall 706 and bottom wall 704 includes one or more slots 710. Slots 710 provide for visual inspection of the contained ammunition band 75 and permit any liquid or debris to exit the chute. The bottom wall 704 includes a ramp 705 at its inward and outward ends to facilitate cartridge advancement.

A pair of parallel cantilevered flex arms 716 extend from side walls 708 in the direction opposite cartridge band travel (i.e. inward). Each includes a latching button 717 on its laterally outer surface, shaped similarly to latching buttons 217 of discharge channel 207 of the embodiment of FIGS. 1 to 6 or latching buttons 317 of feed links 302 of that embodiment. The buttons 717 are cylindrical and of decreasing thickness toward the free ends of flex arms 716, in the direction opposite the direction of ammunition discharge. These buttons form an arcuate retention edge 718 for releasable connection with coacting latching apertures as will be discussed below.

Each side wall 708 includes a cylindrical latching aperture 712 aligned with the latching aperture in the opposite side wall. The apertures 712 are sized to pivotally receive a latching button 717 of another discharge chute feed link 702. The centers of aligned latching apertures 712 are spaced inward from the outward edge of the side wall 708 a distance somewhat shorter than the length of flex arms 716 from side walls 708 to the center of latching buttons 717.

A chute 700 of any desired length is created by connecting a selected number of feed links 702 together by securing latching buttons 717 of one feed link 702 within the latching apertures 712 of an adjacent link. The flex arms 716 are depressed and deformed toward each other to accomplish this connection. Once released, the flex arms 716 return to their parallel relationship maintain the latching buttons 717 within the apertures 712 of the adjacent feed link 702.

The chute 700, created by the feed links 702, is connected to one of the discharge channels 607 of the attachment bracket 600 by placement of the latching buttons 717 of the first link 702 of the chute 700 into the latching apertures 612 of one of the discharge channels 607. The flex arms 716 are deformed toward each other to accomplish this connection. Once released the flex arms 716 return to their parallel relationship. Notably, the inward tapered shape of latching button 717 of flex arms 716 facilitate deformation of arms 716 during the connection process.

A separate connecting link 802 is shown in FIG. 9. Each connecting link 802 is a hollow molded plastic component having a bottom wall 804, a top wall 806 and side walls 808. The walls are spaced similarly to the walls 704, 706 and 708 of feed links 702, that is, to closely surround, but permit free passage of the ammunition band 75.

Top wall 806 and bottom wall 804 include slots 810 for visual inspection purposes, and to assure against collection of debris within the internal channel defined by the walls 804, 806 and 808. Bottom wall 804 includes ramps 805 at its inward and outward ends to assure smooth flow of the cartridge band.

The end links 802 differ from feed links 702 in that they include cantilever arms 816 extending from side walls 808 both in the direction of ammunition travel, and in the direction opposite ammunition travel.

A pair of cantilevered flex arms 816 extend from side walls 808 of each discharge channel 808 in both the direction of ammunition discharge and the direction opposite ammunition discharge. Each arm 816 is integrally molded, and cantilevered from a side wall 808. Each flex arm 816 includes a free end having a latching button 817 on its laterally outer surface for connection to a further component of the assembly.

The latching buttons 817 are cylindrical and of decreasing thickness toward the free ends of arms 816. The buttons form an arcuate retention edge 818 for releasable connection with the coacting latching apertures 612 of side walls 608 of discharge channels 607 and latching apertures 712 of side walls 708 of feed links 702.

Connecting link 802 may be employed to connect a chute 700 of another source, such as an adjacent ammunition container, to the cartridge channel 607 at the opposite end of the attachment bracket 600 from where the bracket 600 includes a discharge chute 700. In this configuration, an ammunition band such as band 75 may be fed into a container from adjacent source.

As in the earlier embodiment, the distance from the inward and outward edges of side walls 808 to the center of each latching button 817 is somewhat longer than the distance from the outward edge of side walls 608 to the center of latching apertures 612 or the distance from the outward edge of side wall 708 to the center of latching apertures 712 of feed links 702.

As in the previous embodiment, spacing of latching apertures and latching buttons relative to the edges of side walls 608, 708 or 808 permits limited pivotal movement of the feed links 702 and connecting link 802 relative to each other and to discharge channel 607. Thus when connected, a degree of flexibility exists between adjacent components.

It is contemplated that the feed guide assembly 500 will be advantageously employed with attachment bracket 600 disposed within an ammunition carrier such as bag 50 with a discharge channel 607 extending outward at each lateral edge of the bag opening. The bag will contain an ammunition band 75 of connected aligned cartridges 77 in serpentine layers.

A discharge chute 700 of predetermined length is formed of pivotally connected feed links 702. That is, the latching buttons 717 of each adjacent feed link 702 are disposed in the latching apertures 712 of an adjacent feed link. The chute 700 is connected to a discharge channel 607 at one end of bracket 600. The latching buttons 717 of the feed link 702 adjacent the discharge channel 607 are disposed in the latching apertures 612 of discharge channel 607. The connected links 702 create a chute 700 sufficiently flexible to accommodate placement of the ammunition band through the hollow interior of the links and into operative association with a weapon by virtue of the pivotal relationship between the latching buttons 717 and the latching apertures 612 and 712.

A free end of ammunition band 75 is passed through discharge channel 607 and through chute 700 for delivery to an associated weapon. The outward feed link 702 presents a pair of latching apertures 712 at its outward end for connection to an appropriate mechanism associated with the weapon.

Alternatively chute 700 may be connected to a discharge channel 607 of another ammunition container for delivery of the ammunition band to that container. In this latter arrangement, connecting link 802 is employed. The latching buttons 817 on one set of cantilevered flex arms 816 are connected to latching apertures 612 of one discharge channel 607. The latching buttons 817 of the opposite pair of cantilevered arms 816 are disposed into latching apertures 712 of the feed link 702 at the end of chute 700. Ammunition may then be fed through chute 700 into the ammunition container.

Notably, the lateral spacing between flex arms 716 of the feed links 702 and the flex arms 816 of connecting links 802 are such that, with the ammunition band in place, the arms cannot be deformed toward each other sufficiently to disconnect the latching buttons 717 or 817 from latching apertures 612 or 712.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The claims are to be construed to include alternative embodiments to the extent permitted by the prior art.

The invention claimed is:

1. An ammunition feed guide assembly for a connected band of ammunition cartridges comprising:

at least one upstanding side plate defining an ammunition discharge channel comprising:

a bottom wall;

a pair of side walls spaced apart a distance greater than the length of a cartridge;

and an ammunition chute connected to said discharge channel to guide the band of ammunition cartridges comprising a plurality of hollow feed links connected together to form a path for passage of a band of ammunition cartridges each hollow feed link comprising a bottom wall, a top wall and a pair of side walls spaced to pass an ammunition band;

wherein said side walls of each said hollow feed link include a cantilever flex arm and a latching aperture, with adjacent hollow feed links of said chute connected together by connection of said flex arms of one said feed link and said latching apertures of an adjacent feed link and, wherein each said cantilevered flex arm includes a generally cylindrical latching button disposed in one of said latching apertures in said side wall of an adjacent hollow feed link to provide limited pivotal movement between adjacent feed links.

2. An ammunition feed guide assembly as claimed in claim 1 wherein said chute includes a hollow end link comprising a bottom wall, a top wall, and a pair of side walls spaced to pass an ammunition band, said end link adapted for connection to a discharge channel of another feed guide assembly wherein each said side wall of said end link includes a pair of latching apertures.

3. An ammunition feed guide assembly as claimed in claim 2 wherein said ammunition feed guide assembly includes an attachment bracket having a base and said at least one upstanding side plate includes a pair of upstanding side plates extending from said base each defining an ammunition discharge channel, with said ammunition chute connected to one of said discharge channels.

4. An ammunition feed guide assembly as claimed in claim 1 wherein said chute includes a hollow end link comprising a bottom wall, a top wall, and a pair of side walls spaced to pass an ammunition band, said end link adapted for connection to a discharge channel of another feed guide assembly wherein said side walls of said end link include a pair of cantilevered flex arms extending therefrom.

5. An ammunition feed guide assembly as claimed in claim 4 wherein said ammunition feed guide assembly includes an attachment bracket having a base and said at least one upstanding side plate includes a pair of upstanding side plates each defining an ammunition discharge channel with said ammunition chute connected to one of said discharge channels.

6. An ammunition feed guide assembly as claimed in claim 1 wherein each side wall of said discharge channel includes a latching aperture, with the cylindrical latching button of the cantilevered flex arm of a hollow feed link adjacent said discharge channel disposed in a latching aperture in one of said side walls of said discharge channel.

7. An ammunition feed guide assembly as claimed in claim 6 wherein said latching buttons are of decreasing thickness toward the free ends of said cantilevered flex arms.

8. An ammunition feed guide assembly as claimed in claim 6 wherein said discharge channel includes at least one tension tab disposed over said bottom wall to apply a restraining force on said ammunition band within said discharge channel.

9. An ammunition feed guide assembly as claimed in claim 8 wherein said ammunition chute includes a hollow end link having a bottom wall, a top wall and a pair of side walls spaced to pass an ammunition band, said side walls each including a pair of latching apertures, the latching buttons of said cantilevered flex arms of one of said hollow feed links disposed in said latching apertures of one of said pairs of latching apertures of said end link.

10. An ammunition feed guide assembly as claimed in claim 6 wherein said ammunition feed guide assembly includes an attachment bracket having a base and said at least one upstanding side plate includes a pair of upstanding side plates extending from said base, each defining an ammunition discharge channel, with said ammunition chute connected to one of said discharge channels.

11. An ammunition feed guide assembly as claimed in claim 1 wherein each side wall of said discharge channel includes a cantilevered flex arm having a generally cylindrical latching button, with the generally cylindrical latching button of each said cantilevered flex arm of said discharge channel disposed in a latching aperture of a hollow feed link disposed adjacent said discharge channel.

12. An ammunition feed guide assembly as claimed in claim 11 wherein said latching buttons are of decreasing thickness toward the free ends of said cantilevered flex arms.

13. An ammunition feed guide assembly as claimed in claim 11 wherein said discharge channel includes at least one tension tab disposed over said bottom wall to apply a restraining force on said ammunition band within said discharge channel.

14. An ammunition feed guide assembly as claimed in claim 13 wherein said ammunition chute includes a hollow end link having a bottom wall, a top wall and a pair of side walls spaced to pass an ammunition band, said side walls each including a pair of cantilevered flex arms extending therefrom, each including a latching button, said latching buttons of one of said pair of cantilevered flex arms disposed in said latching apertures of one of said hollow feed links.

15. An ammunition feed guide assembly as claimed in claim 11 wherein said ammunition feed guide assembly includes an attachment bracket having a base and said at least one upstanding side plate includes a pair of upstanding side plates extending from said base, each defining an ammunition discharge channel, with said ammunition chute connected to one of said discharge channels.

* * * * *